US005941180A

United States Patent [19]

Becker

[11] Patent Number: 5,941,180

[45] Date of Patent: Aug. 24, 1999

[54] CALCULATOR MOUNT

[76] Inventor: Robert D. Becker, 11355 Cragwold Dr., St. Louis, Mo. 63122

[21] Appl. No.: 09/053,096

[22] Filed: Apr. 1, 1998

[51] Int. Cl.[6] ..... A47B 1/04

[52] U.S. Cl. ..... 108/77; 108/152; 248/918

[58] Field of Search ..... 108/90, 26, 77, 108/78, 152; 248/918; 297/188.15, 188.21, 173

[56] References Cited

U.S. PATENT DOCUMENTS

| | | | |
|---|---|---|---|
| 4,083,313 | 4/1978 | Borreson | 108/26 |
| 4,909,159 | 3/1990 | Gonsoulin | 108/44 |
| 5,556,017 | 9/1996 | Troy | 297/188.15 X |
| 5,673,628 | 10/1997 | Boos | 248/918 X |
| 5,709,157 | 1/1998 | Hanusiak | 108/78 |
| 5,765,911 | 6/1998 | Sorenson | 297/173 |

*Primary Examiner*—Jose V. Chen

*Attorney, Agent, or Firm*—Polster, Lieder, Woodruff & Lucchesi, LC

[57] ABSTRACT

A calculator mount includes a self closing hinge with a frame wing and a door wing. The frame wing is attached to a desk with a top and overhang, and a calculator mounting bracket is carried by the door wing. The door wing and bracket swing between a position at which the calculator is at a position adjacent the top surface of the desk and a position at which it folds under the desk. It can be mounted on either side of the desk.

4 Claims, 2 Drawing Sheets

CALCULATOR MOUNT

CROSS-REFERENCE TO RELATED APPLICATIONS

None

STATEMENT REGARDING FEDERALLY SPONSORED RESEARCH OR DEVELOPMENT

Not Applicable.

BACKGROUND OF THE INVENTION

The calculator mount of this invention has particular application for classroom use, in whatever class, as for math and science, in which calculators are used on a somewhat regular basis, although its utility is not limited thereto.

At present, many teachers purchase sets of calculators which they hand out or make available to their students whenever the students need them and then collect them when the students are finished. This wastes a substantial amount of time. In addition, many of the calculators get dropped and broken, and others disappear, either being stolen or unintentionally carried away.

The present invention is intended to permit calculators to be attached to student desk tops or table tops or lab stations or almost any other utilized work surface, all of which are embraced within the term work table as used in the appended claims, to move between a position at which the keyboard of the calculator is adjacent the work surface of the work table to a position at which the calculator is swung down alongside the work surface, and preferably under an overhang of the work table.

One of the objects of this invention is to provide such a device which is simple, easily installed, and not susceptible to casual removal.

Other objects will become apparent to those skilled in the art in the light of the following description and accompanying drawing.

BRIEF SUMMARY OF THE INVENTION

In accordance with this invention, generally stated, a calculator mount is provided that includes a self closing hinge with a frame wing and a door wing. The frame wing is preferably attached to the underside of an overhang of a work table which has a top working surface, a side wall, generally perpendicular to the top surface, and an underside, to which the side wall is also generally perpendicular. The hinge is preferably of a face mount type, in which the door wing has an inset and a riser that, when the hinge is "closed", extends adjacent the side wall of the work table, although a variable overlay or other type of self-closing hinge can be used, depending upon the application. In the preferred embodiment, a leaf of the door wing extends at substantially right angles from the riser. The leaf carries a bracket assembly, which, in the embodiment shown, consists of a fixed clamp part, fixedly mounted on the leaf, and a movable clamp part. The fixed part has a calculator-engaging wall, extending upwardly, with a lip along its outer edge, and a downwardly extending flange, through which a bolt hole extends. The movable part has a calculator-engaging wall with a lip extending in a direction toward the lip of the fixed part, and a flange with a bolt hole aligned with the bolt hole in the fixed part flange. The bolt hole in the fixed flange can either be internally threaded or made large enough to permit a bolt to pass through. In the latter case, a nut is provided, threaded on a threaded shank of a clamping bolt, the bolt extending through both bolt holes, and the head of the bolt being contiguous the flange of the movable clamp part. By virtue of dual compression springs in the self-closing hinge, the bracket, hence the calculator clamped between the lips, is held in a position at which a keyboard of the calculator is adjacent the top surface of the work table, but may be swung down, around the hinge axis, to a position at which the calculator is beneath the overhang of the work table. The top surface of the calculator can either be in a plane parallel to the top surface of the work table, or, to improve the visibility and convenience of the calculator keys, to a position at which the top surface of the calculator angles up toward its outer edge, i.e., extends at an angle greater than ninety degrees from the side wall. To the latter end, the bracket holding the calculator can be bent up or a taller outboard lip provided and a shim inserted under the calculator near its outboard edge. The bolt used to clamp the two bracket members around the calculator can have a Phillips head or, if theft is a problem, an antitheft type head that can be tightened but not loosened. In either case, casual theft is discouraged.

Among the virtues of the device of this invention is that the spring mechanism of the hinge acts like a shock absorber so that if a student is hitting the calculator buttons too hard the spring cushions the blows. In a high school environment, for example, this will prolong the life of the calculator. By hinging out along-side a desk rather than on top of it, the calculator takes up no desk space, hence effectively increases the desk top space when the calculator is employed. By hinging down out of the way, the device allows for side-attachment without blocking classroom aisle space. It also, when hinged down, is essentially hidden from view, reducing the likelihood of theft by an outsider. In most school rooms, during the summer, desks are typically stacked one upside down on top of another, desk top to desk top. The calculators with the mount of this invention, being hinged beneath the desk, permit such stacking. When the calculator is attached to the desk, the teacher need no longer keep track of which student has borrowed a calculator and need not spend class time handing out and collecting calculators. The device may be attached to accommodate either left or right handed students and students of different ages and sizes. When the calculator is attached to the desk, there is no likelihood of its being dropped, greatly prolonging the life of the calculator. The device of this invention is easily attached to a work table, accommodates a number of different calculator shapes and sizes and can clamp the calculators either lengthwise or widthwise.

DETAILED DESCRIPTION OF THE INVENTION

Figure 1:
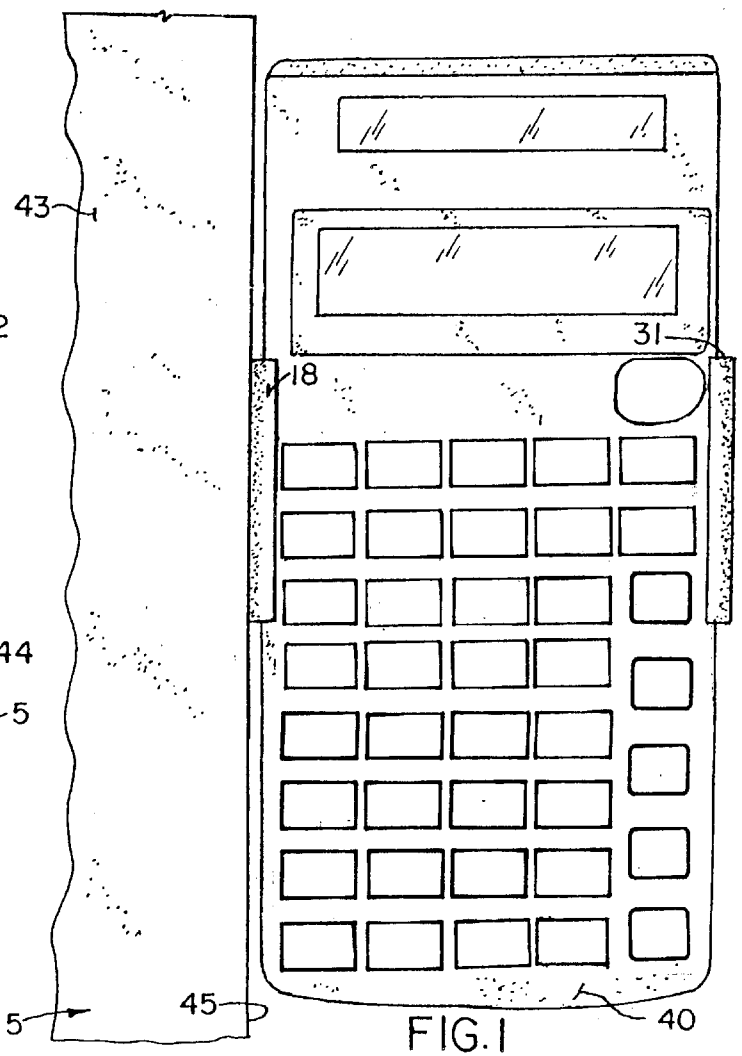
FIG. 1 is a top plan view of a calculator mount of one embodiment of this invention, mounted on a desk, with a calculator clamped in the mount.
Figure 2:
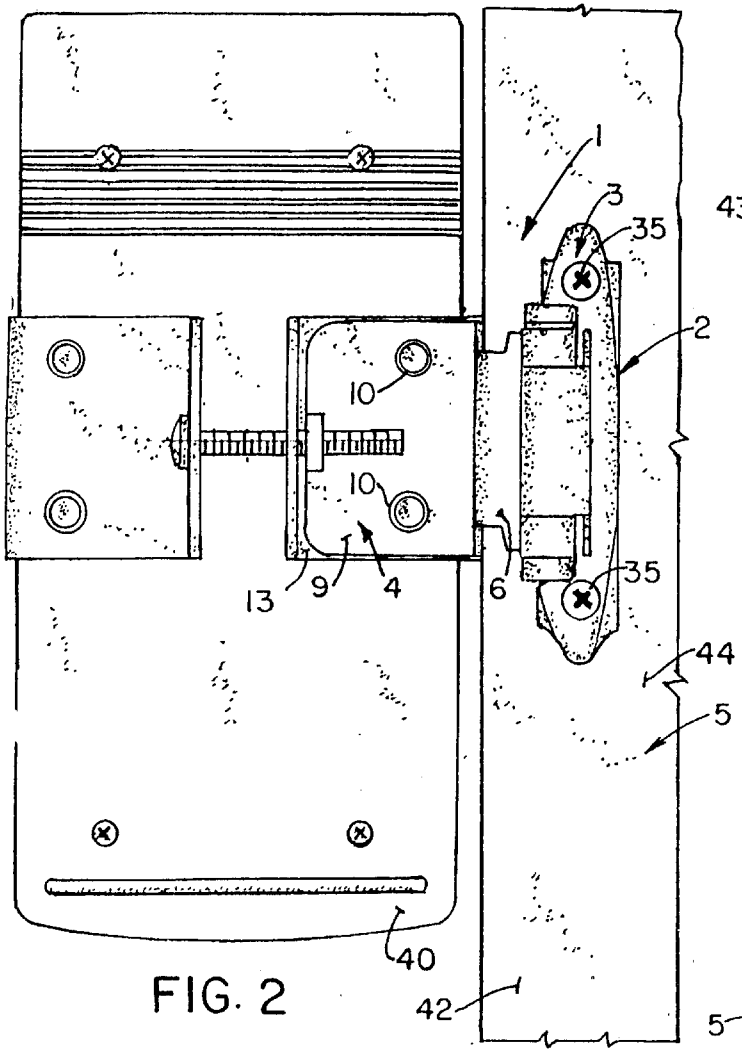
FIG. 2 is a bottom plan view.
Figures 3, 4, 5:
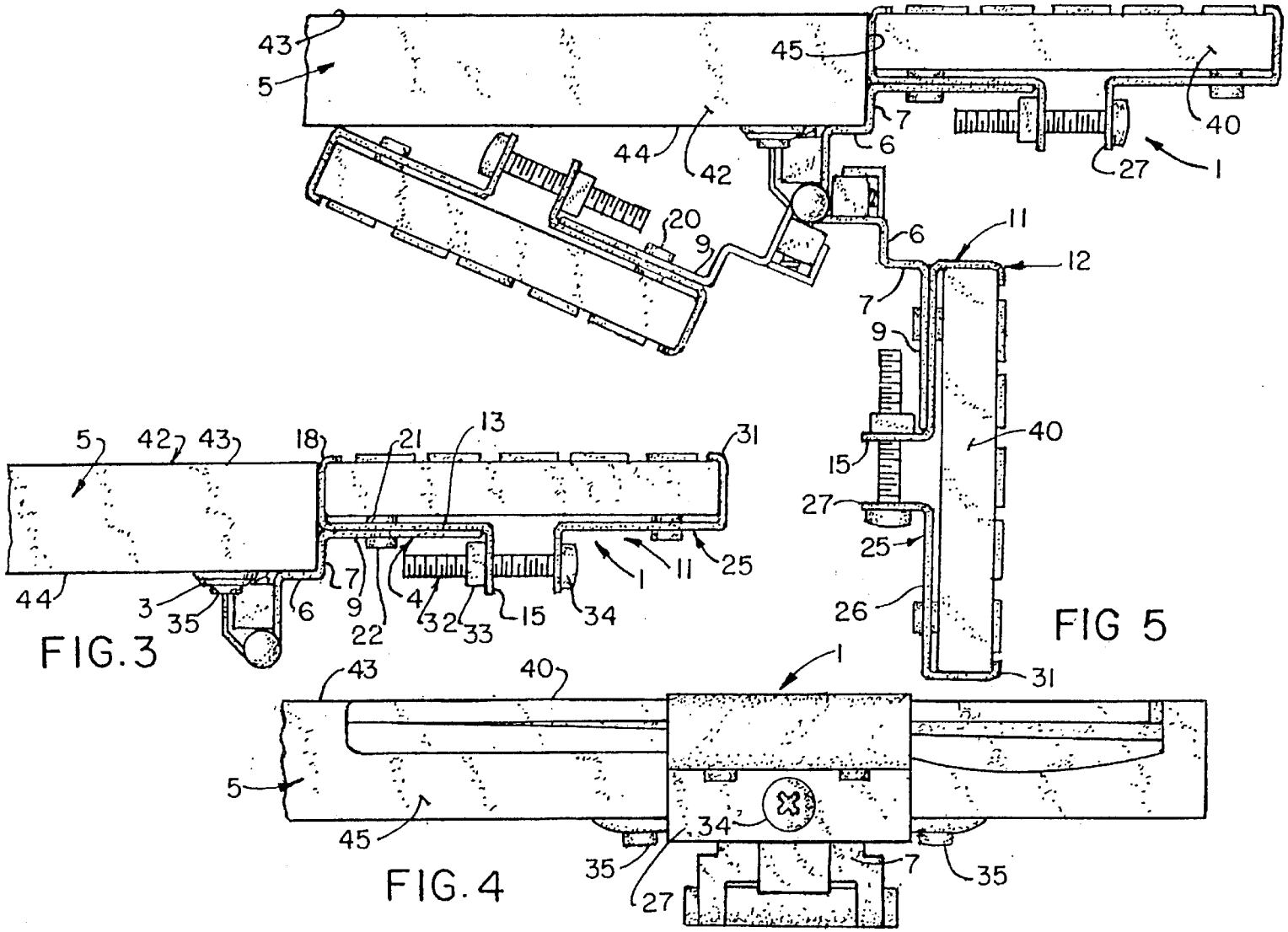
FIG. 3 is a view in end elevation.
FIG. 4 is a view in side elevation viewing from right to left in FIG. 1.
FIG. 5 is a view in end elevation showing three positions of the mount.

Referring now to the drawings for one illustrative embodiment of this invention, reference numeral 1 indicates the complete mount, in which a calculator 40 is mounted. In the embodiment shown, a face mount, self-closing hinge 2, of a type exemplified by Amerock Corporation catalog numbers 7128, 7328 or 7628, among others, as set out in a catalog identified as "form number 170, 2/97", with a frame wing 3 and a door wing 4, is mounted to an under surface 44 of a desktop 5. The desktop 5 has an overhang 42, a top surface 43, and a side wall 45. The hinge frame wing 3 has screw holes in it to receive screws 35 by which it is secured to the under surface 44 of the desk. The door wing 4 of the hinge has a step in it made up of an inset 6 and a riser 7, and a leaf 9, extending substantially perpendicularly from the riser 7. The leaf 9 has the usual screw holes 10 in it.

A bracket 11 is supported by the leaf 9. The bracket 11 has a fixed door wing clamp part 12, with a rectangular flat center plate 13, in which holes complementary to the holes 10 are formed, a flange 15 depending from an edge of the plate 13, through which a clamp bolt hole extends, and at an edge parallel to the flange 15, an upstanding wall ending in a lip 18. The bracket is secured to the plate 13 by means of bolts 20, with heads 21, and nuts 22. If rivets are used instead of the bolts 20, their ends are peened or expanded.

An outer clamp part 25 of the bracket 11 consists, in this embodiment, of a rectangular plate 26, with two parallel sides from one of which a flange 27 depends, with a clamp bolt hole in it aligned with the clamp bolt hole in the flange 15, and an upstanding wall ending in a lip.31 at a side of the outer clamp part opposite the flange 27. The lip 31 tends toward the lip 18, so that together they hold a calculator 40 against upward displacement. They extend above the top surface of the calculator, and engage that surface or an edge of the calculator contiguous that surface. If the calculator is especially thick, it usually is made with a groove running around its sides intermediate its height, into which the lips of the bracket can extend, although caution should be exercised in that case not to wedge the case apart with the lips. The outer clamp plate has holes in it to receive bolts or rivets designed to support a calculator 40 clamped between the lips 18 and 31 in substantially the same plane as the heads 21 of the fasteners 20. In both instances, the heads of the bolts or flanges can serve as supporting posts for a rubber ring or cap, if desired, or the holes in the upper surface of the plates 13 and 26 can be countersunk to receive a flat head fastener flush with the surface of the plate. If the head extends above the surface, it is preferable that it be flat on top.

A clamp bolt 32, with a head 34 and a nut 33, extends through the holes in the flanges 15 and 27. In the embodiment illustrated, the clamp bolt head has a Phillips type recess. As has been indicated, the hole in the flange 15 can be internally threaded to receive the threaded shank of the bolt 32. Where theft is not a problem, the bolt 32 can be replaced by one or more springs or other mounting devices. The flanges can be made narrow, or even as posts, to accommodate springs, or the flanges can be bent away from one another to take a trapezoidal clamp (e.g. heavy binder clip) or the like.

If the work surface has insufficient overhang to permit the calculator to be swung under the top, the calculator can still be swung down to the side of the work surface. If the work surface has no overhang at all, a butt hinge with a frame wing in the form of a leaf and a door wing in the form of a leaf can be used, with a magnetic latch or spring catch to hold the bracket horizontally. Calculator retaining means different from the lips of the preferred embodiments can be used. For example, if the movable bracket part is viewed as a throw-away, the calculator can even be adhered to it, and the lip wall eliminated or not. The side surface of some work tables, such as desks, may be rounded, but a plane through the upper and lower edges of the side surface is substantially perpendicular to the top surface and undersurface. Various moldings defining the side surface may have a projecting part or parts, but a riser or leaf of the hinge, abutting such a projection or curve, will extend substantially perpendicularly to the top, and the term generally perpendicular as used herein applied to the side wall, embraces such surfaces. Instead of the inboard and outboard walls' and the lips' 18 and 31 being integral with the plates 13 and 26, respectively, the lips can be made adjustable heightwise, in the manner of clamps, although this makes the device more complicated and tends to weaken the security aspect of the device. These variations are merely illustrative. Numerous other variations in the construction of the device of this invention, within the scope of the appended claims, will occur to those skilled in the art in the light of the foregoing disclosure.

I claim:

1. In combination with a work table having a top surface and a side surface along the top surface and generally perpendicular to said top surface, a calculator mount comprising a hinge having a frame wing fastened to said table and a door wing having a planar area swingable from an upper position at least ninety degrees from said side surface to a lower position at least ninety degrees from said top surface in a direction below said top surface, bracket means carried by said door wing for mounting a calculator on said door wing, and means for retaining said door wing, hence said calculator, in said upper position and for permitting said door wing selectively to be swung to said lower position in a direction below said top surface, said work table having an overhang with a lower surface, said frame leaf being mounted on said lower surface, and a riser, integral with said frame leaf. extending along said side wall.

2. A cuculator mount comprising a self-closing hinge with a frame wing and a door wing, means for securing said frame wing to a work table a bracket assembly carried by said door wing, said bracket assembly comprising a fixed part fixedly mounted on said door wine, said fixed part having a calculator-engaging lip, and a movable part having a compalementary calculator-engaging lip, and means connecting said fixed part and said movable part for movement toward one another, whereby a calculator can be clamped between them, said self-closing hinge being a face mount hinge the door wing of which has an inset, a riser, and a plate on which said bracket assembly is mounted, said bracket assembly fixed part having a plate with two parallel sides, from one of which sides a flange with a bolt hole in it depends, said flange extending in a direction away from said calculator, and from the other of said two sides a wall extends in a direction opposite the said flange, said wall having said fixed part lip along an outer edge; and said movable part having a plate with two parallel sides, from one of which sides a flange with a bolt hole in it depends, aligned with said fixed part flange bolt hole, said flange extending in a direction away from said calculator, and from the other of said two sides a wall extends in a direction opposite the said flange, said wall having said movable part lip along an outer edge, said lips facing one another.

3. In combination with a work table having a top with a top surface and an overhang on at least one side, said overhang having a lower planar surface and a side surface, a calculator holder comprising a spring loaded, self-closing hinge having a frame wing mounted to said lower surface, a door wing having an inset part, a riser, and a leaf, said riser extending along and contiguous said overhang side surface when said hinge is in closed position, a first clamp member mounted on said leaf, and a second, relatively movable clamp member connected to said first clamp member and means for selectively moving said clamp members toward one another to clamp a calculator between them, said door wing and clamp members being swingable between a hinge open position at which said calculator is adjacent said top surface and a hinge open position at which they are beneath said overhang.

4. The combination of claim 3 wherein said first clamp member is fixedly mounted on said hinge leaf, has a wall abutting said side surface and extending upwardly toward the work table top surface with a calculator-engaging lip along an outer edge extending in a direction away from said side surface and a flange extending downwardly away from said top surface when the hinge is in its closed position, said flange having a bolt-receiving hole in it, and said second clamp member having a downwardly extending flange with a bolt-receiving hole in it aligned with said first clamp member flange hole and an upwardly extending wall with a calculator-engaging lip along an upper edge, and a bolt extending through said flange holes.

* * * * *

UNITED STATES PATENT AND TRADEMARK OFFICE

CERTIFICATE OF CORRECTION

PATENT NO : 5,941,180

DATED : August 24, 1999

INVENTOR(S) : Robert D. Becker

It is certified that error appears in the above-identified patent and that said Letters Patent is hereby corrected as shown below:

Col. 4, line 36
replace "cuculator"
with --calculator--.

Col. 4, line 38
replace "table a bracket"
with --table, a bracket--.

Col. 4, line 40
replace "wine"
with --wing--.

Signed and Sealed this

Fifth Day of September, 2000

*Attest:*

*Attesting Officer*

Q. TODD DICKINSON

*Director of Patents and Trademarks*